US010077628B2

(12) United States Patent
Arabskyy

(10) Patent No.: US 10,077,628 B2
(45) **Date of Patent: *Sep. 18, 2018**

(54) TOOL AND METHOD FOR FRACTURING A WELLBORE

(71) Applicant: Tartan Completion Systems Inc., Edmonton (CA)

(72) Inventor: Serhiy Arabskyy, Nisku (CA)

(73) Assignee: Tartan Completion Systems Inc., Edmondton (CA)

( * ) Notice: Subject to any disclaimer, the term of this patent is extended or adjusted under 35 U.S.C. 154(b) by 10 days.

This patent is subject to a terminal disclaimer.

(21) Appl. No.: 15/064,287

(22) Filed: Mar. 8, 2016

(65) Prior Publication Data

US 2017/0022782 A1 Jan. 26, 2017

Related U.S. Application Data

(63) Continuation of application No. 13/832,770, filed on Mar. 15, 2013, now Pat. No. 9,297,241.
(Continued)

(51) Int. Cl.
*E21B 34/14* (2006.01)
*E21B 34/06* (2006.01)
(Continued)

(52) U.S. Cl.
CPC ..... *E21B 34/063* (2013.01); *E21B 34/14* (2013.01); *E21B 43/14* (2013.01); *E21B 43/26* (2013.01); *E21B 2034/007* (2013.01)

(58) Field of Classification Search
CPC ..... E21B 34/063; E21B 43/14; E21B 34/14; E21B 43/26; E21B 2034/007; E21B 43/16
See application file for complete search history.

(56) References Cited

U.S. PATENT DOCUMENTS 6,131,662 A 10/2000 Ross
7,096,954 B2 8/2006 Weng et al.
(Continued)

FOREIGN PATENT DOCUMENTS

CA 2441757 10/2002
CA 2412072 5/2003
(Continued)

*Primary Examiner* — Brad Harcourt
(74) *Attorney, Agent, or Firm* — Ryan W. Dupuis; Ade + Company Inc.; Kyle R. Satterthwaite

(57) ABSTRACT

A fracturing tool is used for hydraulically fracturing multiple stages of a well bore with treatment fluid. The tool includes a tubular housing retaining a longitudinally sliding sleeve which moves between a first position concealing fluid ports in the tubular housing and a second position in which the ports are uncovered. A deformable seat disposed in the sliding sleeve cooperates with an actuating member which is directed downwardly through a fracturing string locating a plurality of tools therein associated with respective stages of an isolated zone to sequentially uncover the fluid ports. Disposed in the fluid ports are burst plugs arranged to open when exposed to a threshold pressure. All uncovered burst plugs of the tools within the isolated zone can thus be sequentially uncovered and then opened when exposed to the threshold pressure to permit the treatment fluid to exit from the housing into the surrounding well bore.

16 Claims, 8 Drawing Sheets

Related U.S. Application Data

(60) Provisional application No. 61/675,009, filed on Jul. 24, 2012.

(51) Int. Cl.

| | |
|---|---|
| ***E21B 43/26*** | (2006.01) |
| ***E21B 43/14*** | (2006.01) |
| *E21B 34/00* | (2006.01) |

(56) References Cited

U.S. PATENT DOCUMENTS

| | | | |
|---|---|---|---|
| 7,581,596 | B2 | 9/2009 | Reimert et al. |
| 7,673,673 | B2 | 3/2010 | Surgaatmadja et al. |
| 8,167,047 | B2 | 5/2012 | Themig et al. |
| 8,215,411 | B2 | 7/2012 | Flores et al. |
| 8,245,788 | B2 | 8/2012 | Garcia et al. |
| 8,267,178 | B1 | 9/2012 | Sommers et al. |
| 8,479,822 | B2 | 7/2013 | Hofman et al. |
| 8,613,321 | B2 | 12/2013 | Ravensbergen et al. |
| 8,695,716 | B2 | 4/2014 | Ravensbergen et al. |
| 8,794,331 | B2 | 8/2014 | Getzlaf et al. |
| 8,869,898 | B2 | 10/2014 | Xu et al. |
| 9,004,180 | B2 | 4/2015 | Jackson |
| 9,228,421 | B2 | 1/2016 | Kent et al. |
| 9,297,241 | B2 * | 3/2016 | Arabskyy ..... E21B 34/14 |
| 9,404,343 | B2 | 8/2016 | Themig et al. |
| 2011/0155377 | A1 | 7/2011 | Laun |
| 2011/0192613 | A1 | 8/2011 | Garcia et al. |

FOREIGN PATENT DOCUMENTS

| | | |
|---|---|---|
| CA | 2692377 | 9/2010 |
| CA | 2760107 | 11/2010 |
| CA | 2670218 | 12/2010 |
| CA | 2683432 | 12/2010 |
| CA | 2716834 | 5/2011 |
| CA | 2824767 | 8/2012 |
| CA | 2772277 | 10/2012 |
| CA | 2755848 | 4/2013 |
| CA | 2797457 | 7/2013 |
| WO | 2012065259 | 5/2012 |
| WO | 2013016822 | 2/2013 |
| WO | 2014053062 | 4/2014 |

* cited by examiner

TOOL AND METHOD FOR FRACTURING A WELLBORE

This application is a continuation of U.S. patent application Ser. No. 13/832,770, filed Mar. 15, 2013, which claims the benefit under 35 U.S.C. 119(e) of U.S. provisional application Ser. No. 61/675,009, filed Jul. 24, 2012.

FIELD OF THE INVENTION

The present invention relates to hydraulic fracturing of a wellbore, and more particularly, the present invention relates to a tool and method for the selective hydraulic fracturing of multiple areas of a wellbore.

BACKGROUND

Hydraulic fracturing is a stimulation treatment which consists of propagating fractures in rock layers by the introduction of pressurized treatment fluid. The treatment fluid is pumped at high pressure into the hydrocarbon bearing area of a wellbore that extends into the target reservoir. The high pressure fluid when introduced to the wellbore causes cracks or fractures which extend back and away from the wellbore into the surrounding rock formation.

Depending on the nature of the reservoir and the particular rock formation, acid, chemicals, sand or other proppants are selectively mixed into the treatment fluid to improve or enhance the recovery of hydrocarbons within the formation.

There have been a number of recent developments with respect to wellbore treatment tools including the development of fracturing strings for staged well treatment. Such fracturing strings are predicated on creating a series of isolated zones within a wellbore using packers. Within each zone there are one or more fluid ports that can be selectively opened from the surface by the operator. A common mechanism comprises a sliding sub actuated by a ball and seat system, the movement of which is used to open fluid ports. By sizing the seats and balls in a complimentary manner, increasingly larger balls may be used to selectively activate a particular sliding sub allowing the operator to stimulate specific target areas.

Further development and refinement has resulted in fracturing strings having multiple fluid ports within each isolated zone. The seats and balls are sized such that one ball may be used to actuate a series of sliding subs within an isolated zone or a series of sliding subs in different isolated zones. This is achieved using seats that expand or deform to allow the ball to pass. The ball is deployed from the surface and it travels down the well bore becoming lodged on the deformable seat forming a temporary seal. The fluid pressure on the ball and seat actuates the sliding sub into its second position, in the process opening the fluid port. The seat eventually deforms allowing the ball to pass and the ball moves down to the next sliding sub which it actuates in the same manner. The last or lowest seat in the isolated zone is sized such that the ball will not pass and thus forms a seal preventing the flow of treatment fluid to lower zones that may have already been actuated. The use of multiple fluid ports allows multiple stages within the isolated zone to be stimulated with one surface treatment.

When using a fracturing string using multiple deformable seats and a single ball, as described above, the user may encounter difficulties in fracturing the lower regions of the formation within the isolated zone. The reason is that the seats are designed so that greater fluid pressure is needed to push the ball past the lower situated seats than the higher situated seats. Such greater fluid pressure, however, may be sufficient to force the fluid from the string into the wellbore and fracture the formation surrounding the already opened higher fluid ports. This results in a loss of fluid which is counterproductive to increasing fluid pressure in the fracturing string. Accordingly, the user may be unable to achieve sufficient fluid pressure to push the ball past the seats and actuate the subs situated in the lower regions of the formation. Even if the user can achieve sufficient pressure to activate the subs in the lower regions of the formation, the pressure may still be suboptimal for stimulating the lower regions of the formation. Prior art solutions have enjoyed limited success and are relatively complicated.

What is needed is a tool, and a method of using the same, for preventing the escape of treatment fluid from fluid ports within an isolated zone of a fracturing string until the treatment fluid pressure has been raised to the level required for hydraulic fracturing. This would better ensure that all fluid ports within an isolated zone can be opened and provide for more effective stimulation of the surrounding formation throughout the isolated zone.

SUMMARY OF THE INVENTION

According to one aspect of the invention there is provided a fracturing tool for use with an actuating member in a fracturing string for hydraulically fracturing a wellbore with treatment fluid, the fracturing tool comprising:

a tubular housing extending longitudinally between opposing first and second ends arranged for connection in series with the fracturing string, the tubular housing having:

an inner surface defining a central bore extending through the tubular housing from the first end to the second end, and at least one fluid port extending from the inner surface to an outer surface of the tubular housing for fluid communication between the central bore and the wellbore;

a burst plug disposed in said at least one fluid port, the burst plug being operable from a closed condition in which the burst plug prevents the treatment fluid flowing through the fluid port to an open condition in which the burst plug is arranged to allow treatment fluid flowing through the fluid port in response to a prescribed threshold hydraulic pressure level of the treatment fluid; and a sleeve member supported within the central bore of the tubular housing so as to be longitudinally slidable relative to the tubular housing between a first position in which said at least one fluid port is covered by the sleeve member and a second position in which said at least one fluid port is substantially unobstructed by the sleeve member, the sleeve member comprising:

a central passageway extending longitudinally therethrough; and a deformable seat disposed in the central passageway so as to be operable between a first condition in which the deformable seat is adapted to receive the actuating member seated thereon and a second condition in which the deformable seat is adapted to allow the actuating member to pass through the central passageway;

the deformable seat being operable from the first condition to the second condition only upon displacement of the sleeve member into the second position.

In one embodiment of the invention the tool is pressure actuated. In this instance the deformable seat and the actuating member seated thereon are arranged to substantially form a seal against the flow of treatment fluid whereby the sleeve member is movable from the first position to the second position when the deformable seat and actuating member seated thereon are exposed to an actuation hydraulic pressure level of treatment fluid which is less than the threshold hydraulic pressure level of the treatment fluid.

The activation hydraulic pressure level of the treatment fluid may be about 2000 psi, and the threshold hydraulic pressure level of the treatment fluid may be about 4000 psi for example.

In some embodiments, the actuating member may comprise a generally cylindrical shuttle member having a central passage extending longitudinally therethrough and a ball seat disposed in the central passage of the actuating member so as to be arranged to form a seal against flow of treatment fluid when a ball is seated on the ball seat. Preferably the shuttle member is arranged to pass through the central passageway of the tubular housing when the sleeve member is displaced to the second position and the deformable seat of the sleeve member is displaced to the second condition to actuate a series of tools with a single shuttle member. In this instance, when the central passageway of the sleeve member has a prescribed inner diameter which is substantially equal to an inner diameter of at least a portion of the central bore of the tubular housing, preferably the actuating member has an outer diameter which is substantially equal to said prescribed inner diameter.

In alternative arrangements, the actuating member may comprise a ball arranged to be seated on the deformable seat so as to form the seal against the flow of treatment fluid. In this instance the central passageway may include a constriction having a prescribed inner diameter which is less than an inner diameter of the inner surface of at least a portion of the central bore of the tubular housing so that the ball is arranged to be seated in the deformable seat which is disposed within the constriction.

In some embodiments the tool is mechanically actuated. In this instance at least a portion of the actuating member is arranged to be supported on a tubing string and has an outer diameter which is arranged to be greater than an outer diameter of the tubing string.

Typically the tool is used in combination with a plurality of other fracturing tools of like configuration connected in series with one another in a fracturing string spanning a plurality of isolated zones having multiple stages associated with each zone such that each fracturing tool is associated with a respective stage of a respective isolated zone. In this instance, a single actuating member is preferably associated with each isolated zone so as to be arranged to sequentially actuate all of the fracturing tools within the respective isolated zone.

Preferably a lowermost one of the fracturing tools within each isolated zone is arranged to prevent displacement of the actuating member through the fracturing string beyond a bottom end of the respective isolated zone.

The actuating member of each isolated zone may comprise a ball having a prescribed diameter which is different than the other actuating members. In this instance, preferably each actuating member is arranged to pass through each fracturing tool associated with one of the isolated zones above the respective isolated zone without displacing the sleeve member into the second position of any fracturing tool above the respective isolated zone.

Alternatively, the actuating member of each isolated zone may comprise a generally cylindrical shuttle member and a respective ball associated therewith in which the shuttle member has a central passage extending longitudinally therethrough and a ball seat disposed in the central passage of the actuating member so as to be arranged to form a seal against the flow of treatment fluid when the respective ball is seated on the ball seat. In this instance, the ball of each isolated zone is preferably arranged to pass through the shuttle member of each fracturing tool associated with one of the isolated zones above the respective isolated zone without actuating the shuttle member to displace the sleeve members of the respective fracturing tools into the second position.

According to a second aspect of the present invention there is provided a method of hydraulically fracturing multiple stages within a lower isolated zone in a wellbore with a treatment fluid, the method comprising the steps of:

i) providing an actuating member associated with the lower isolated zone;

ii) providing a plurality of fracturing tools connected in series with one another in a fracturing string spanning the lower isolated zone such that each fracturing tool is associated with a respective stage of the lower isolated zone, each fracturing tool comprising:

a tubular housing extending longitudinally between opposing first and second ends and having an inner surface defining a central bore extending through the tubular housing and at least one fluid port extending from the inner surface to an outer surface of the tubular housing for fluid communication between the central bore and the wellbore;

a burst plug disposed in said at least one fluid port, the burst plug being operable from a closed condition in which the burst plug prevents the treatment fluid flowing through the fluid port to an open condition in which the burst plug is arranged to allow treatment fluid flowing through the fluid port in response to a prescribed threshold hydraulic pressure level of the treatment fluid; and a sleeve member supported within the central bore of the tubular housing so as to be longitudinally slidable relative to the tubular housing between a first position in which said at least one fluid port is covered by the sleeve member and a second position in which said at least one fluid port is substantially unobstructed by the sleeve member, the sleeve member comprising a central passageway extending longitudinally therethrough and a deformable seat disposed in the central passageway so as to be operable between a first condition in which the deformable seat is adapted to receive the actuating member seated thereon and a second condition in which the deformable seat is adapted to allow the actuating member to pass through the central passageway, wherein the deformable seat is operable from the first condition to the second condition only upon displacement of the sleeve member into the second position;

iii) directing the actuating member downwardly through the fracturing string to sequentially displace the sleeve member of each fracturing tool associated with the lower isolated zone into the second position;

iv) locating the actuating member within a lowermost one of the fracturing tools associated with the lower isolated zone so as to form a seal against a flow of the treatment fluid; and v) pumping the treatment fluid to achieve the threshold hydraulic pressure level to open the burst plugs in the fluid ports and hydraulically fracture the well bore within the lower isolated zone.

When the actuating member comprises a ball and a generally cylindrical shuttle member arranged to be seated on the deformable seats of the fracturing tools of the lower isolated zone, preferably the method further comprises directing the ball of the actuating member downwardly through the fracturing string such that the shuttle member sequentially passes through the tubular housings of the fracturing tools of the lower isolated zone.

When the actuating member comprises a ball arranged to be seated on the deformable seat of each fracturing tool of the lower isolated zone, preferably the method includes directing the ball downwardly through the fracturing string such that the ball sequentially passes through the tubular housings of the fracturing tools of the lower isolated zone.

When using pressure to actuate the fracturing tools, the method preferably includes sequentially seating the actuating member on the deformable seat of each fracturing tool of the lower isolated zone so as to substantially form a seal against the flow of treatment fluid. The sleeve member of each fracturing tool can then be driven from the first position to the second position by pumping the treatment fluid to expose the respective deformable seat and the actuating member seated thereon to an actuation hydraulic pressure level of treatment fluid which is less than the threshold hydraulic pressure level of the treatment fluid.

When mechanically actuating the fracturing tools, the method preferably includes supporting at least a portion of the actuating member on a tubing string and lowering the tubing string within the fracturing string.

When also hydraulically fracturing multiple stages within an upper isolated zone above the lower isolated zone, the method typically comprises the additional steps of: i) associating one of the plurality of fracturing tools with each of the stages of the upper isolated zone, and ii) providing an actuating member associated with the upper isolated zone in addition to the actuating member associated with the lower isolated zone, wherein each actuating member being arranged to sequentially actuate only the fracturing tools within the respective isolated zone.

Typically the actuating member is prevented from being displaced downwardly through the fracturing string beyond a bottom end of the respective isolated zone.

According to one embodiment, when also hydraulically fracturing multiple stages within the upper isolated zone, the actuating member of the lower isolated zone comprises a ball having a prescribed diameter which is arranged to be seated on the deformable seat of each fracturing tool of the lower isolated zone and which is arranged to pass through the deformable seat of each fracturing tool of the upper isolated zone without being seated thereon, and the actuating member of the upper isolated zone comprises a ball having a prescribed diameter which is arranged to be seated on the deformable seat of each fracturing tool of the upper isolated zone. The method in this instance may further comprise the steps of:

i) directing the ball of the lower isolated zone downwardly through the fracturing string such that the sleeve members in the upper isolated zone remain in the first position and the sleeve members in the lower isolated zone are sequentially displaced into the second position;

ii) pumping the treatment fluid to achieve the threshold hydraulic pressure level to open the burst plugs in the fluid ports and hydraulically fracture the well bore within the lower isolated zone;

iii) directing the ball of the upper isolated zone downwardly through the fracturing string such that the sleeve members in the upper isolated zone are sequentially displaced into the second position;

iv) locating the ball of the upper isolated zone within a lowermost one of the fracturing tools associated with the upper isolated zone so as to form a seal against a flow of the treatment fluid; and v) pumping the treatment fluid to achieve the threshold hydraulic pressure level to open the burst plugs in the fluid ports and hydraulically fracture the well bore within the upper isolated zone.

According to a second embodiment, when also hydraulically fracturing multiple stages within the upper isolated zone, the actuating member of each isolated zone may comprise a generally cylindrical shuttle member and a respective ball associated therewith. Preferably the shuttle member of each isolated zone is arranged to be seated on the deformable seat of each fracturing tool of the respective isolated zone and has a central passage extending longitudinally therethrough within which is disposed a ball seat. Preferably the ball of the lower isolated zone has a prescribed diameter which is arranged to be seated on the ball seat of the shuttle member of the lower isolated zone and which is arranged to pass through the ball seat of the shuttle member of the upper isolated zone without being seated thereon. Also preferably the ball of the upper isolated zone has a prescribed diameter which is arranged to be seated on the ball seat of the shuttle member of the upper isolated zone. In this instance the method may further comprise the steps of:

i) directing the ball of the lower isolated zone downwardly through the fracturing string such that the ball passes unseated through the shuttle member of the upper isolated zone and the sleeve members in the upper isolated zone remain in the first position and such that the ball is seated on the shuttle member of the lower isolated zone and the sleeve members in the lower isolated zone are sequentially displaced into the second position;

ii) pumping the treatment fluid to achieve the threshold hydraulic pressure level to open the burst plugs in the fluid ports and hydraulically fracture the well bore within the lower isolated zone;

iii) directing the ball of the upper isolated zone downwardly through the fracturing string such that the ball is seated on the shuttle member of the upper isolated zone and the sleeve members in the upper isolated zone are sequentially displaced into the second position;

iv) locating the ball and shuttle member of the upper isolated zone within a lowermost one of the fracturing tools associated with the upper isolated zone so as to form a seal against a flow of the treatment fluid; and v) pumping the treatment fluid to achieve the threshold hydraulic pressure level to open the burst plugs in the fluid ports and hydraulically fracture the well bore within the upper isolated zone.

Some embodiments of the invention will now be described in conjunction with the accompanying drawings in which:

Figure 1:
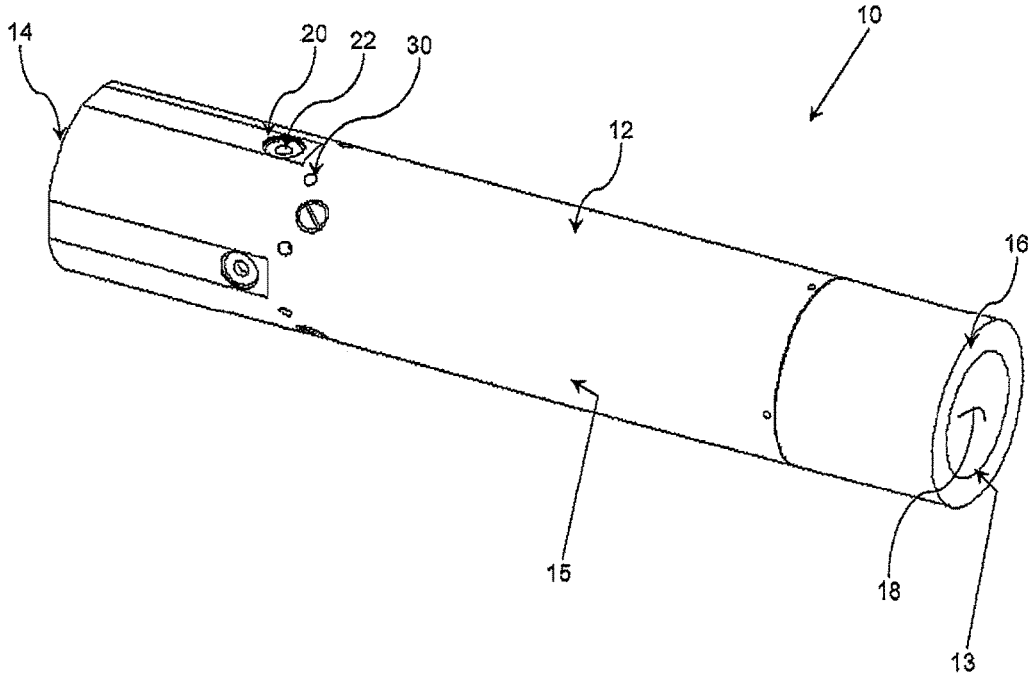
FIG. 1 is a perspective view of a first embodiment of the fracturing tool according to the present invention.
Figure 2:
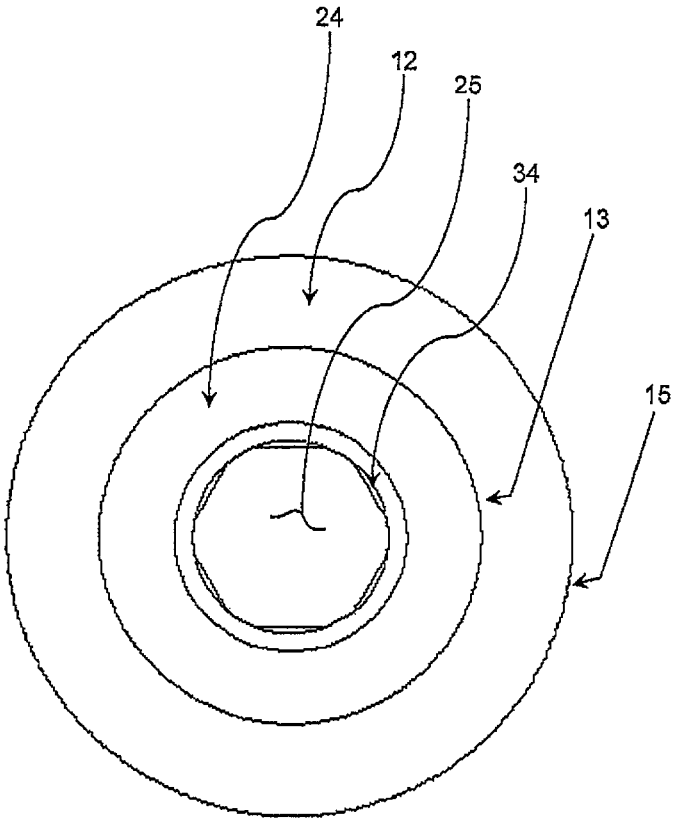
FIG. 2 is a cross sectional end view of the tool according to the first embodiment of FIG. 1.

In the drawings like characters of reference indicate corresponding parts in the different figures. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION

The invention relates to a fracturing tool 10 and a method for the hydraulic fracturing of multiple stages within an isolated zone in a wellbore. When describing the present invention, all terms not defined herein have their common art-recognized meanings. To the extent that the following description is of specific embodiments or particular uses of the invention, it is intended to be illustrative only, and not limiting of the claimed invention. The following description is intended to cover all alternatives, modifications and equivalents that are included in the spirit and scope of the invention, as defined in the appended claims.

Although various embodiments of the invention are described in the following, the common features of the various embodiments will first be described. Generally the tool 10 includes: i) a tubular housing 12 for connection in series with a fracturing string with one or more fluid ports 20 communicating between a central bore of the housing and the wellbore, ii) a burst plug 22 disposed in each fluid port, iii) a sleeve member 24 movable within the housing between a first position covering the fluid ports 20 and a second position in which the burst plugs are exposed, and iv) a deformable seat 26 defined by dogs 34 disposed within a central passageway in the sleeve member. The deformable seat 26 is operable from a first condition arranged to receive an actuating member 36 seated thereon to a second condition in which the actuating member is arranged to pass through the tool only once the sleeve member has been displaced from the first position to the second position. Once the sleeve member is in the second position and the deformable seat 26 is displaced into the second condition, the actuating member is free to pass through the tool to the next tool in the fracturing string in a series of tools associated with an isolated zone.

The actuating member 36 may be directed downwardly through the fracturing string to be seated on the deformable seats 26 of respective tools by various methods including mechanical actuation and pressure actuation. In the instance of mechanical actuation, the actuating member can be supported at the bottom end of a tubing string so as to be displaced downwardly through the fracturing string to actuate respective fracturing tools by injecting the tubing string into the fracturing string. When multiple different diameter actuating members are provided for being associated with different isolated zones respective, the tubing string used to convey the actuating member has an outer diameter which is less than a smallest diameter actuating member being used.

In addition to different methods of actuation, the configuration of the actuating member itself may take various different forms as described in the following examples.

Figure 3:
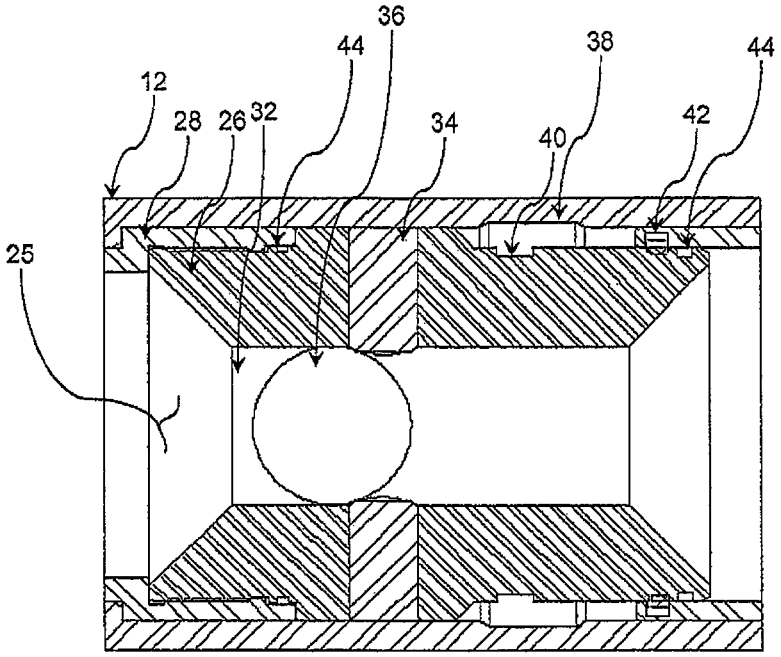
FIG. 3 is a longitudinal cross sectional view of the seat and ball of the tool according to the first embodiment of FIG. 1 in the first position of the sleeve with the deformable seat in the first condition.
Figure 4:
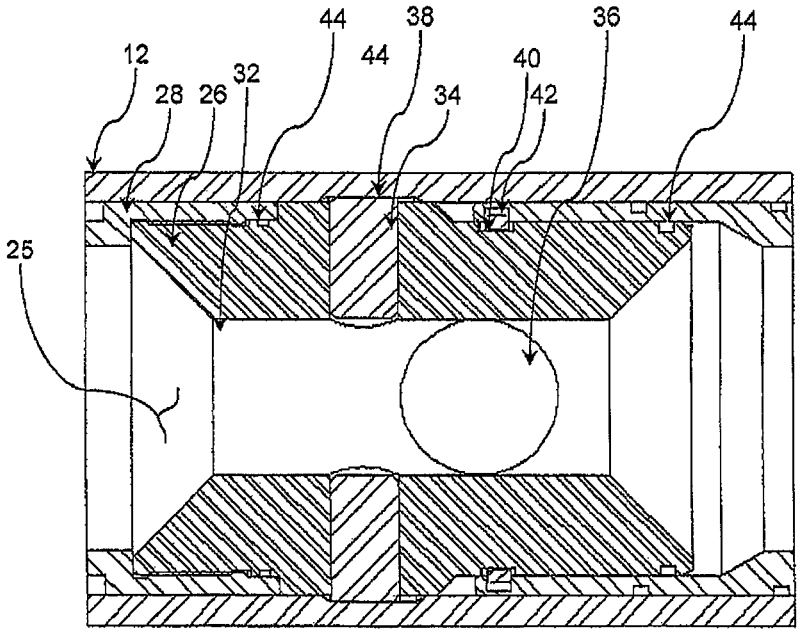
FIG. 4 is a longitudinal cross sectional view of the seat and ball of the tool according to the first embodiment of FIG. 1 in the second position of the sleeve with the deformable seat in the second condition.
Figure 5:
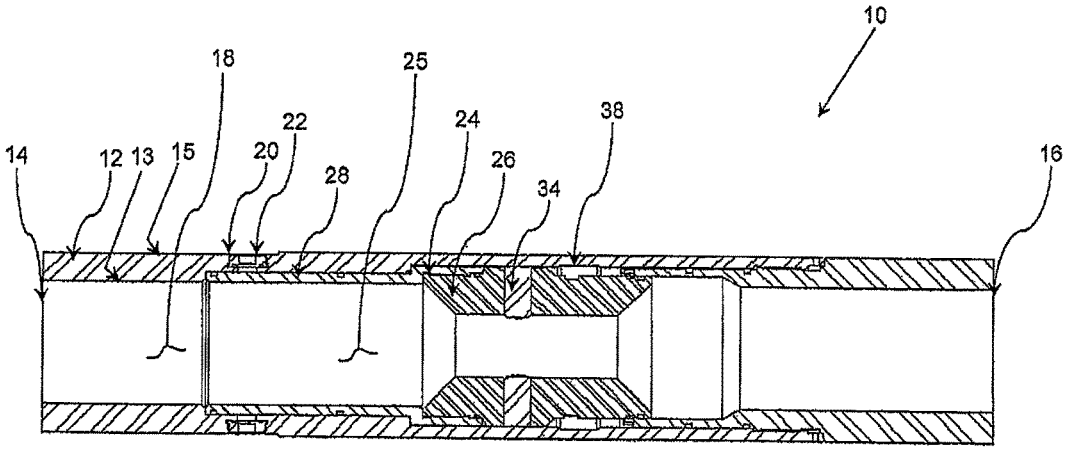
FIG. 5 is a longitudinal cross sectional view of the sleeve member of the tool according to the first embodiment of FIG. 1 in the first position of the sleeve with the deformable seat in the first condition.
Figure 6:
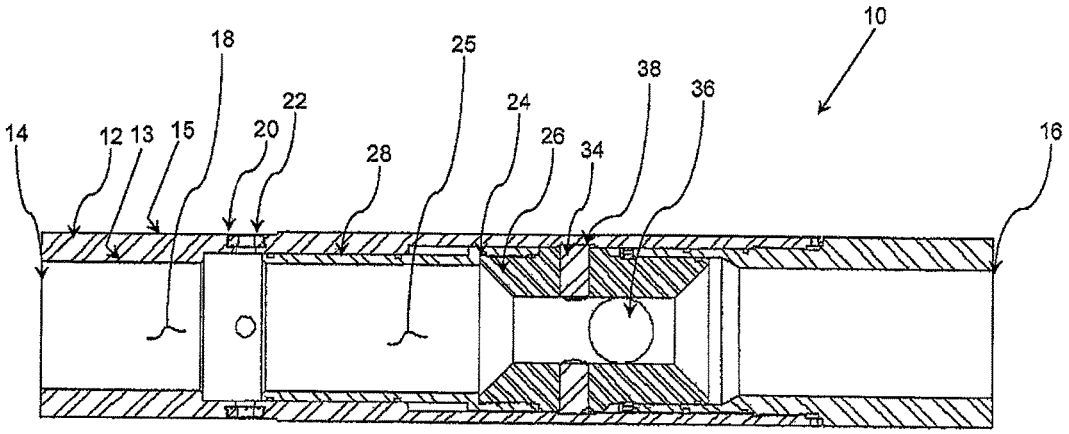
FIG. 6 is a longitudinal cross sectional view of the sleeve member of the tool according to the first embodiment of FIG. 1 in the second position of the sleeve with the deformable seat in the second condition.
Figure 7:
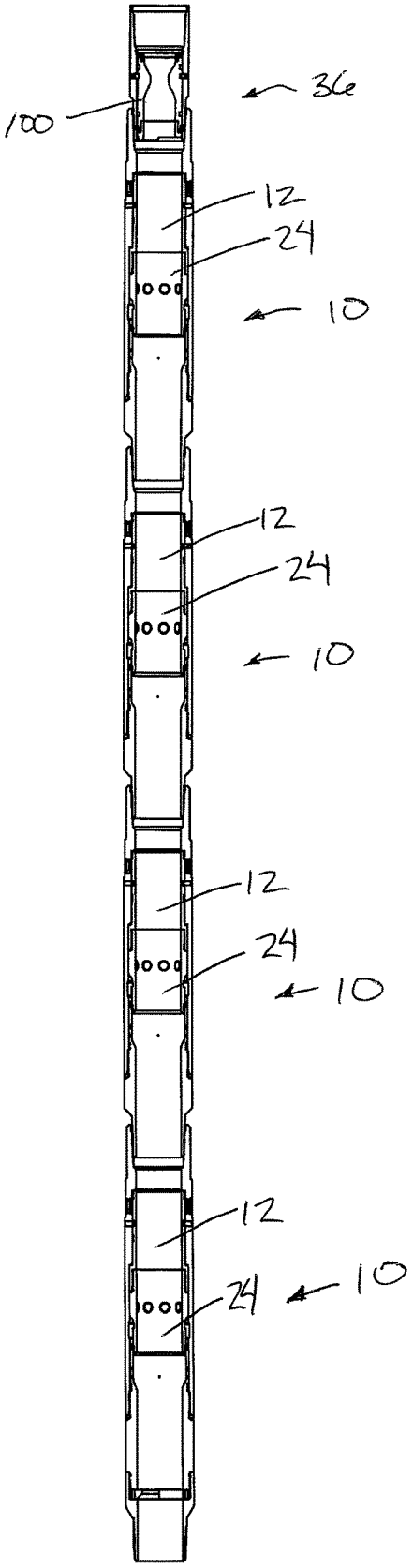
FIG. 7 is a longitudinal cross sectional view of a fracturing string including a plurality of fracturing tools according to a second embodiment of the present invention.
Figure 8:
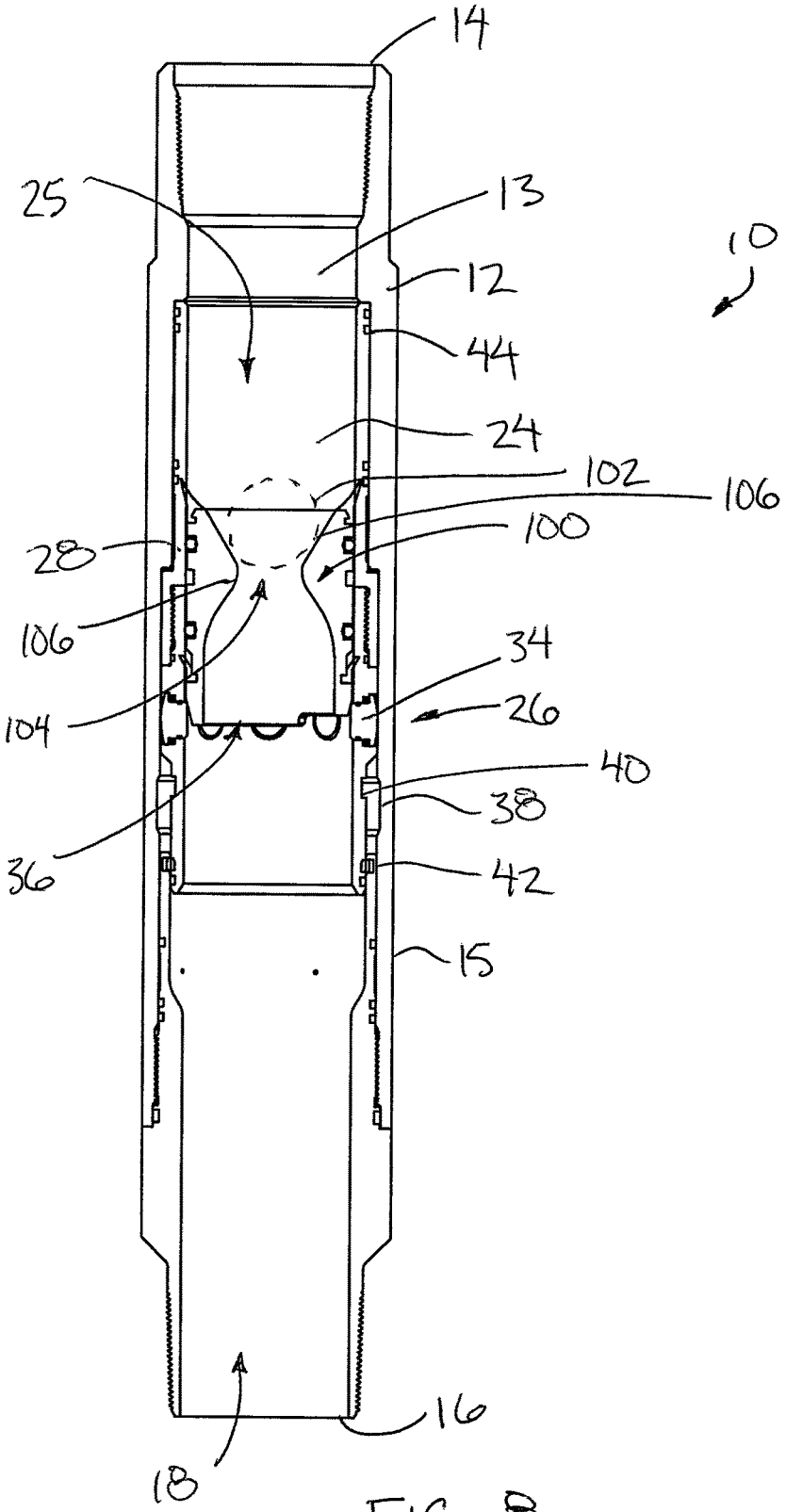
FIG. 8 is a longitudinal cross sectional view of the tool according to the second embodiment of FIG. 7 in the first position of the sleeve with the deformable seat in the first condition.
Figure 9:
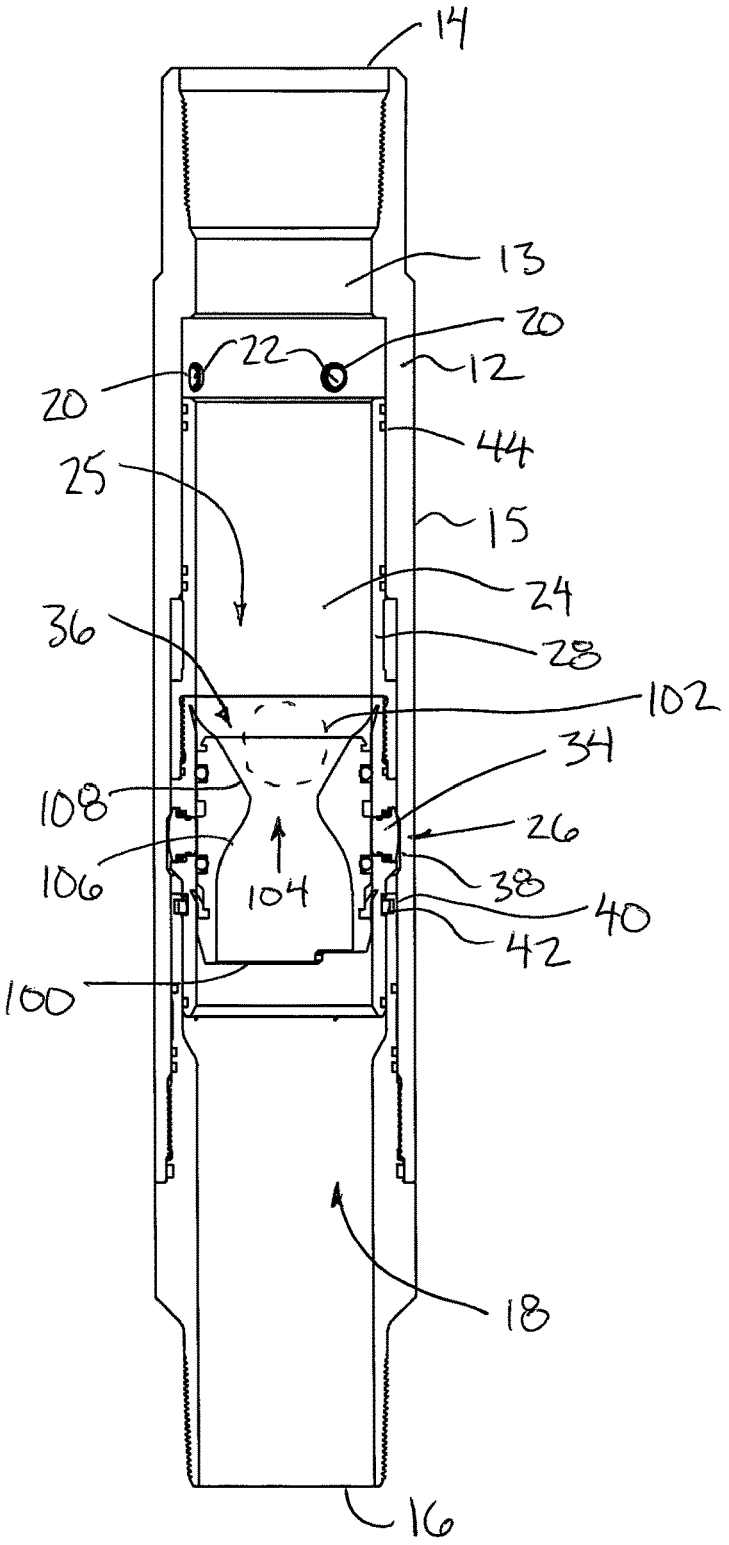
FIG. 9 is longitudinal cross sectional view of the tool according to the second embodiment of FIG. 7 in the second position of the sleeve with the deformable seat in the second condition.
Figure 10:
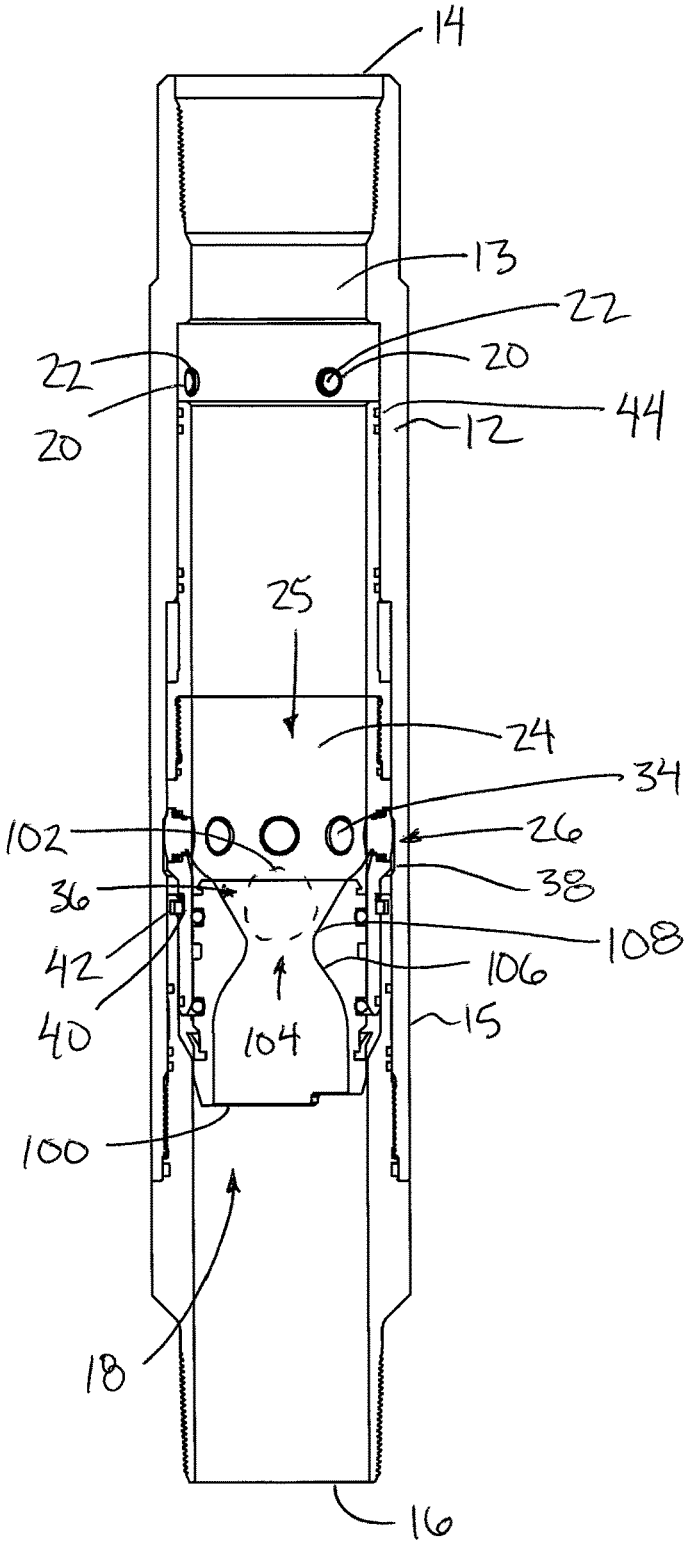
FIG. 10 is longitudinal cross sectional view of the tool according to the second embodiment of FIG. 7 in the second position of the sleeve with the deformable seat in the second condition in which the shuttle member is shown passing through the sleeve member for subsequently actuating another tool therebelow.

Turning initially to the first embodiment shown in FIGS. 1 through 6, one example of a pressure actuated fracturing tool will now be described in further detail. FIG. 1 depicts an external perspective view of one embodiment of the tool 10 of the present invention while FIGS. 5 and 6 show cross-sectional side views. The tool 10 is comprised of the tubular housing 12 extending longitudinally between a first end 14 and an opposing second end 16 arranged for connection in series within the fracturing string. The tubular housing has an inner surface 13 and an outer surface 15, the inner surface 13 defining a central bore 18 extending along the longitudinal axis of the tubular housing 12 from its first end 14 to its second end 16. Both the first end 14 and the second end 16 of the tubular housing 12 are configured to attach to a fracturing string such that the tool 10 may be installed into a fracturing string.

The tubular housing 12 has at least one fluid port 20 extending from the outer surface 15 to the inner surface 13 of the tubular housing from the central bore 18 in an orientation that is substantially perpendicular to the longitudinal axis of the tubular housing 12. The fluid ports 20 allow fluid communication between the central bore 18 of the tubular housing 12 and the wellbore. In a preferred embodiment there is a plurality of fluid ports 20 positioned in a ring like configuration around the tubular housing as shown in FIG. 1. Each fluid port has a burst plug 22 disposed therein. In one embodiment the burst plug 22 is retained in the fluid port 20 by a threaded connection or a retaining ring.

The burst plugs are operable from a closed condition in which the burst plug prevents the treatment fluid flowing through the respective fluid port to an open condition in which the burst plug is arranged to allow treatment fluid flowing through the respective fluid port. The burst plugs may be any suitable member or mechanism which can be operated to open from the closed condition in response to the treatment fluid reaching a prescribed threshold hydraulic pressure level. In preferred embodiments, the burst plug comprises a material with consistent mechanical properties, such as a metal, which is arranged to burst, rupture or shear in response to the prescribed threshold hydraulic pressure level of the treatment fluid.

The burst plug 22 acts as a barrier preventing fluid communication between the central bore 18 and the wellbore. The burst plugs 22 are configured to maintain their physical integrity, and thereby maintain a fluid seal, up to a certain threshold fluid pressure level. When the threshold fluid pressure is reached within the central bore 18 of the tubular housing 12, the burst plugs 22 open, for example by bursting, rupturing or shearing, and the flow of fluid from the central bore 18 to the wellbore through the fluid ports 20 occurs. In one embodiment, the burst plugs 22 will open at a fluid pressure of approximately 4000 psi pounds per square inch.

In this instance, pressure in the treatment fluid can be gradually pumped up to the threshold fluid pressure level prior to the burst plugs 22 being opened, so as to store considerable potential energy in the fluid. By arranging all of the burst plugs within one tool or a series or tools spanning one isolated zone in a fracturing string to open at substantially the same threshold fluid pressure level, the stored energy can be quickly or suddenly discharged throughout all of the isolated zone to improve frac initiation throughout the isolated zone.

The sleeve member 24 typically comprises a tubular sleeve having a central fluid passageway 25 is slidably mounted within the central bore 18 of the tubular housing 12 such that the central fluid passageway of the sleeve 24 is orientated in the same manner as the central bore 18 of the tubular housing 12, and such that the tubular housing 12 and the sleeve 24 share a common longitudinal axis.

The sleeve 24 is comprised of a deformable seat 26 and an interconnected upper collar 28. In one embodiment, the upper collar 28 and the seat 26 attach by means of complimentary threads. The sleeve 24 slides along the longitudinal axis of the tubular housing 12 in a direction towards the second end 16 of the tubular housing 12.

The sleeve 24 is moveable between a first position shown in FIG. 5 whereby the collar 28 is positioned such that it covers the fluid ports 20 blocking the flow of fluid from the central bore 18 to the fluid ports 20, and a second position shown in FIG. 6 whereby the collar 28 no longer covers the fluid ports 20 and the fluid ports 20 are exposed to fluid in the central bore 18.

In one embodiment, shear pins 30 are utilized to releasably hold the sleeve 24 in its first position pending actuation as will be described below. One skilled in the art will understand that other suitable means as commonly employed in the industry may also be used to releasably hold the sleeve 24 pending actuation.

The seat 26 is shaped to form a constriction 32 in the central passage 25. A plurality of dogs 34 are mounted within machined bores formed in the constriction 32 and orientated in a direction that is substantially perpendicular to the longitudinal axis of the central bore 18 and central passageway 25. As shown in the cross sectional end view shown in FIG. 2, the dogs 34 extend into the central passageway 25.

The actuating member 36 in this instance comprises a ball. When an appropriately sized ball 36 is discharged into the fracturing string with treatment fluid, it moves down the string until becomes lodged on the dogs 34 of the seat 26 as shown in FIG. 3. The ball 36 blocks the constriction 32 in the central passageway 25 and reduces the flow of fluid through the central fluid passageway 25. The pressurized treatment fluid exerts a hydraulic force on the ball and seat breaking the shear pins 30 and causing the slidable seat 26 and attached collar 28 to move towards the second end 16 of the tubular housing 12. It is not necessary that the ball 36 and the seat 26 create a perfect seal against the flow of fluid. Rather, the ball 36 and the seat 26 need only reduce the flow of fluid to create a sufficient pressure differential upstream and downstream of the ball 36 so that the resultant force is sufficient to actuate sleeve 24 and, as discussed below, drive the ball through the sleeve 26.

The tubular housing 12 is machined such that there is a recess 38 in the inner wall of the tubular housing 12 that allows the expansion of the dogs 34. As the sleeve 24 slides towards the second end 18 of the tubular housing 12 the dogs 34 meet and expand into the recess 38 as shown in FIG. 4. As the dogs 34 expand outwards into the recess 38 they retract slightly from the central passageway 25. This retraction allows the ball to pass as shown in FIGS. 4 and 6. At the same time as the dogs 34 expand into the recess, a machined groove 40 in the seat 26 mates with a projection 42 on the inner surface 13 of the tubular housing 12 which locks the sleeve 24 into its second actuated position.

As can be seen in FIG. 6, at this point, the collar 28 no longer covers the fluid port 20 and the fluid port 20 is exposed to fluid within the central bore 18. Although the embodiment described above uses dogs 34 to form the deformable seat, such suggestion is not intended to be limiting and one skilled in the art will appreciate that other ball and seat mechanisms commonly employed in the industry may be used instead.

In this manner, one actuating member can be used to actuate a series of tools having the same sized seat. The tools are placed in series in the string and are isolated by conventional isolating means, such as packers or cement, to define the zone to be stimulated. The last, or lowest, tool in the zone has a seat sized such that even after actuation into its second position, the ball is not able to pass through the seat. This prevents the flow of fluid to lower zones. It can be understood that by using balls of increasing diameter, and starting with a ball having the smallest diameter, a series of isolated zones, starting with the one furthest from the well head, may be sequentially activated. For example, two to ten tools may be placed in each isolated zone. Thus, a fracturing string having ten packer isolated zones, with each zone containing ten tools, will allow an operator to stimulate one hundred stages, with just ten surface treatments.

As can be seen in the Figures, a series of seals 44 are positioned throughout the tool so as to be operatively supported between the sleeve member and the tubular housing such that the sleeves prevent the leak of treatment fluid from the tubular housing to the fluid ports in the first position of the sleeve member which would impair the ability maintain elevated hydraulic pressures.

Operation of the tool will now be described. A tubing string with one or more of the present tools 10 is lowered into the wellbore. Conventional isolation means such as packers mounted on the string or cement lining are used to create isolated treatment zones.

Each isolated treatment zone may contain one or more of the present tools 10. According to the embodiment of FIGS. 1 through 6, a ball 36 is placed into the treatment fluid and is introduced to the string. The ball passes through the string until it becomes lodged on the seat 26 of a tool in the target zone. The operator increases the pressure of the treatment fluid. In one embodiment, the pressure is increased to approximately 2000 psi. The ball 36 is pressed against the dogs 34 urging the sleeve 24 into its second position, and displacing the dogs 34 radially outward into the recesses 38 so that the ball 36 may pass through the sleeve 24. The fluid ports 20 on the actuated tool are now exposed to the treatment fluid passing down the string and through the central bore, but the burst plug 22 prevents fluid communication with the wellbore. The same process is repeated for each respective tool 10 located in the selected zone until the ball 36 reaches the final tool 10 which is sized to prevent its passage even after the sleeve 24 is moved into its second position. At this point, the fluid ports 20 of all of the actuated tools 10 are uncovered, but not yet open. The operator then pressurizes the treatment fluid to the level needed to hydraulically fracture the wellbore. Upon reaching the threshold pressure, in one embodiment 4000 psi, the burst plugs 22 all open at generally the same time and the opened fluid ports 20 allow fluid communication with the wellbore. There is no compromise in the pressure of the treatment fluid and all of the stages within the isolated zone are exposed to treatment fluid at the desired high pressure levels.

The use of fluid ports 20 covered by a collar 28 and each having a burst plug 22, is simple, effective and relatively economic. The burst plugs 22 prevent fluid communication with the well bore until the treatment fluid has been pressured to the levels needed to hydraulically fracture the wellbore. Furthermore, the burst plugs 22 facilitate simultaneous fluid communication with the wellbore through all opened fluid ports in the isolated zone.

The tool 10 of FIGS. 1 through 6 can also be milled out increase production. The ball 36 flows back up the fracturing string during the recovery phase of the fracturing operation.

Turning now to the second embodiment of FIGS. 7 through 10, a further example of a pressure actuated fracturing tool will now be described in further detail. The second embodiment differs from the first embodiment primarily with regard to the configuration of the deformable seat 26 and the configuration of the actuating member 36 arranged to be seated on the deformable seat 26 as described in the following.

In the second embodiment, the configuration of the tubular housing 12 is substantially identical in that there is provided a central bore 18 defined by the inner surface 13 extending longitudinally between the opposing first end 14 and second end 16 arranged for connection in series with the fracturing string. The fluid ports 20 are similarly circumferentially spaced about the tubular housing so as to extend radially from the inner surface 13 to the outer surface 15 for fluid communication between the central bore and the wellbore. A burst plug 22 is disposed in each fluid port to prevent the treatment fluid flowing through the fluid port until the burst plug is opened by exposure to the prescribed threshold hydraulic pressure level of the treatment fluid.

The sleeve member 24 of the second embodiment is also similarly supported within the central bore of the tubular housing so as to be longitudinally slidable relative to the tubular housing between the first position in which the fluid ports are covered by the sleeve member and the second position in which the fluid ports are substantially unobstructed by the sleeve member.

As in the previous embodiment, the tubular housing 12 includes a central portion of increased internal diameter which receives the sleeve member 24 therein. The sleeve member is again formed of an upper collar 28 and a lower collar threadably connected to the upper collar 28 to define the deformable seat 26. The upper collar 28 and the lower collar are arranged so that they have a common outer diameter received within the central portion of the tubular housing 12 so as to be longitudinally slidable therein. An inner diameter of both the upper and lower collars forming the sleeve member 24 in this embodiment is constant across the full length of the sleeve member in the longitudinal direction of the string in which the inner diameter is substantially identical to the inner diameter of the inner surface 13 of the tubular housing 12 at end portions at both axially opposed ends of the central portion receiving the sleeve member therein.

The constant inner diameter of the sleeve member 24 defines the central passageway 25 extending longitudinally through the sleeve member between the axially opposing ends thereof. The deformable seat 26 disposed within the central passageway again comprises dogs 34 which extend inwardly into the central passageway in a first condition such that the resulting inner diameter of the central passageway at the dogs 34 is reduced. As in the previous embodiment, when the sleeve member is displaced to the second position, the dogs 34 align with the recess 38 to allow the dogs to be expanded outwardly from the first condition to the second condition. In the second condition, the inner diameter at the dogs 34 is the same as the remainder of the sleeve member and the tubular housing at opposing ends of the central portion receiving the sleeve member therein.

A similar configuration of projections 42 received in a machined groove 40 retains each sleeve member in the second position once displaced from the first position.

Though different in configuration than the previous embodiment, a single actuating member 36 is again associated with a series of fracturing tools associated with a single isolated zone of a fracturing string spanning multiple zones. The actuating member 36 in this instance comprises both a generally cylindrical shuttle member 100 and a ball 102 which cooperates with the shuttle member 100 as described in the following. The shuttle member has an outer diameter which is substantially equal to a prescribed inner diameter of the central passageway of the sleeve member and the end portions of the central bore through the tubular housing so as to be suited for longitudinally sliding of the shuttle member through a series of tools in the fracturing string associated with a respective zone. The shuttle member 100 is thus arranged to be seated on the deformable seat 26 of each tool of the respective isolated zone in the first condition of the seat, but the deformable seat is adapted in the second condition to allow the actuating member to pass through the central passageway and through the tool for actuating a subsequent tool therebelow.

The shuttle member 100 also comprises a sleeve having a central passage 104 extending longitudinally therethrough between opposing first and second ends. The central passage 104 has a constriction 106 wherein the internal diameter is reduced to define a ball seat 108 disposed in the central passage of the actuating member. The ball seat 108 is arranged to receive the ball 102 and form a seal against flow of treatment fluid when a ball is seated on the ball seat.

In a typical use of the fracturing tool 10, a plurality of the fracturing tools of similar configuration are connected in series with one another in a fracturing string spanning a plurality of isolated zones having multiple stages associated with each zone such that each fracturing tool is associated with a respective stage of a respective isolated zone. Each isolated zone includes a respective shuttle member 100 and cooperating ball 102 associated therewith so that the resulting actuating member comprised of the shuttle member 100 and ball 102 seated thereon is arranged to sequentially actuate all of the fracturing tools within the respective isolated zone. A lowermost one of the fracturing tools within each isolated zone is arranged to prevent displacement of the actuating member through the fracturing string beyond a bottom end of the respective isolated zone though.

The ball of each isolated zone is arranged to pass through the shuttle member of each fracturing tool associated with one of the isolated zones above the respective isolated zone without actuating the shuttle member and without displacing the sleeve members of the respective fracturing tools into the second position. Within the respective zone however, the shuttle member 100 is arranged to be seated on the deformable seat 26 of each fracturing tool 10 in the first condition of the seat.

When there is provided a lower isolated zone and an upper isolated zone, each comprised of multiple stages for example, the ball of the lower isolated zone has a prescribed diameter which is arranged to be seated on the ball seat of the shuttle member of the lower isolated zone. The constriction 106 in the shuttle member 100 of the upper zone has a greater inner diameter than the constriction 106 of the lower zone such that the diameter of the lower ball 102 is arranged to pass through the ball seat of the shuttle member of the upper isolated zone without being seated thereon and without displacing the shuttle member of the upper isolated zone to be seated on the various deformable seats 26 of the tools of the upper zone. The ball of the upper isolated zone however has a prescribed diameter which is greater than the ball of the lower zone so as to be arranged to be seated on the ball seat 108 of the shuttle member of the upper isolated zone.

The use of the fracturing tools 10 according to the second embodiment involves providing a fracturing tool 10 associated with each stage of a plurality of zones comprising multiple stages per zone. Each zone includes a single actuating member associated with all tools in that zone. The shuttle member 100 is initially positioned within the fracturing string above the uppermost tool of the respective zone and all sleeve members are initially in the first position.

A lowermost zone is initially isolated by directing the ball associated with that zone downwardly through the fracturing string to be seated within the respective shuttle member by pumping the treatment fluid downwardly through the fracturing string. Once the ball is seated on the shuttle member, continued pumping of treatment fluid directs the shuttle member downwardly to be sequentially seated on the deformable seats of the associated tools to sequentially displace the sleeve member of each fracturing tool associated with the lower isolated zone into the second position. Once the shuttle member and associated ball are located within a lowermost one of the fracturing tools associated with the lower isolated zone, further downward movement is prevented so as to form a seal against a flow of the treatment fluid. Continued pumping of the treatment fluid to achieve the threshold hydraulic pressure level then opens the burst plugs in the fluid ports of the lower isolated zone to hydraulically fracture the well bore within the lower isolated zone.

The upper zone is subsequently isolated for fracturing by directing the ball of the upper isolated zone downwardly through the fracturing string such that the ball is seated on the shuttle member of the upper isolated zone and the sleeve members in the upper isolated zone are sequentially displaced into the second position. Once the ball and shuttle member of the upper isolated zone are located within a lowermost one of the fracturing tools associated with the upper isolated zone, the ball and actuating member are prevented from further downward displacement so as to form a seal against a flow of the treatment fluid. Continued pumping of the treatment fluid to achieve the threshold hydraulic pressure level then opens the burst plugs in the fluid ports and hydraulically fractures the well bore within the upper isolated zone.

As in the previous embodiment, by uncovering all burst plugs in an isolated zone prior to opening the burst plugs, pressure in the treatment fluid can be gradually pumped up to the threshold fluid pressure so as to store considerable potential energy in the fluid. By further arranging all of the burst plugs within one tool or a series or tools spanning one isolated zone in a fracturing string to open at substantially the same threshold fluid pressure level, the stored energy can be quickly or suddenly discharged throughout all of the isolated zone to improve frac initiation throughout the isolated zone.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A fracturing string in combination with an actuating member for hydraulically fracturing a wellbore with treatment fluid using a prescribed threshold hydraulic pressure level, the fracturing string and actuating member comprising:

a plurality of fracturing tools connected in series with one another spanning an isolated zone of the wellbore such that each of the plurality of fracturing tools is associated with a respective stage of the isolated zone;

the actuating member being associated with the isolated zone to sequentially actuate each of the plurality of fracturing tools within the isolated zone;

a lowermost tool within the isolated zone having a seat sized to prevent displacement of the actuating member through the fracturing string beyond a bottom end of the isolated zone;

each of the plurality of fracturing tools including:

a tubular housing extending longitudinally between opposing first and second ends arranged for connection in series with the fracturing string, the tubular housing having:

an inner surface defining a central bore extending through the tubular housing from the first end to the second end, and at least one fluid port extending from the inner surface to an outer surface of the tubular housing for fluid communication between the central bore and the wellbore;

a burst plug disposed in the at least one fluid port, the burst plug being operable from a closed condition, in which the burst plug maintains a fluid seal to prevent the treatment fluid flowing through the fluid port below the prescribed threshold hydraulic pressure level, to an open condition, in which the burst plug is opened in response to the prescribed threshold hydraulic pressure level of the treatment fluid to allow the treatment fluid to flow through the fluid port;

a sleeve member supported within the central bore of the tubular housing so as to be longitudinally slidable relative to the tubular housing between a first position in which the burst plug of the at least one fluid port is covered by the sleeve member and a second position in which the burst plug of the at least one fluid port is substantially unobstructed by the sleeve member, the sleeve member comprising:

a central passageway extending longitudinally therethrough; and a deformable seat disposed in the central passageway so as to be operable between a first condition in which the deformable seat is adapted to receive the actuating member seated thereon and a second condition in which the deformable seat is adapted to allow the actuating member to pass through the central passageway;

the deformable seat being operable from the first condition to the second condition only upon displacement of the sleeve member into the second position: and seals operatively supported between the sleeve member and the tubular housing to prevent leaking of the treatment fluid from the tubular housing to the at least one fluid port in the first position of the sleeve member.

2. The fracturing string and actuating member according to claim 1, wherein the deformable seat and the actuating member seated thereon are arranged to substantially form a seal against the flow of the treatment fluid so that the sleeve member is movable from the first position to the second position when the deformable seat and actuating member seated thereon are exposed to an actuation hydraulic pressure level of the treatment fluid which is less than the prescribed threshold hydraulic pressure level of the treatment fluid.

3. The fracturing string and actuating member according to claim 2 wherein the central passageway of the sleeve member has a prescribed inner diameter which is substantially equal to an inner diameter of at least a portion of the central bore of the tubular housing and wherein the actuating member has an outer diameter which is substantially equal to the prescribed inner diameter.

4. The fracturing string and actuating member according to claim 2 wherein the actuating member comprises a generally cylindrical shuttle member having a central passage extending longitudinally therethrough and a ball seat disposed in the central passage of the actuating member adapted to form a seal against flow of the treatment fluid when a ball is seated on the ball seat, wherein the shuttle member is arranged to pass through the central passageway of the tubular housing when the sleeve member is displaced to the second position and the deformable seat of the sleeve member is displaced to the second condition.

5. The fracturing string and actuating member according to claim 2 wherein the actuating member comprises a ball arranged to be seated on the deformable seat so as to form the seal against the flow of the treatment fluid.

6. The fracturing string and actuating member according to claim 5 wherein the central passageway includes a constriction having a prescribed inner diameter which is less than an inner diameter of the inner surface of at least a portion of the central bore of the tubular housing, the deformable seat being disposed within the constriction.

7. The fracturing string and actuating member according to claim 1 adapted to sequentially fracture a plurality of the isolated zones, wherein:

the plurality of fracturing tools are connected in series with one another spanning the plurality of isolated zones such that each of the plurality of fracturing tools is associated with a respective stage of a respective isolated zone;

the actuating member is one of a plurality of actuating members and each of the plurality of actuating members is associated with one of the respective isolated zones;

the lowermost tool within each of the isolated zones has the seat sized to prevent displacement of the actuating member through the fracturing string beyond the bottom end of the respective isolated zone;

the burst plug of the at least one fluid port in each of the plurality of fracturing tools associated with the respective isolated zone is operable from the closed position to the open condition in response to the prescribed threshold hydraulic pressure level of the treatment fluid; and the actuating member associated with each of the plurality of isolated zones comprises a ball having a prescribed diameter associated with the plurality of fracturing tools for a respective isolated zone and which is different than the diameter of the ball associated with the other isolated zones, such that each of the plurality of actuating members is arranged to pass through each fracturing tool associated with one of the isolated zones above the respective isolated zone without displacing the sleeve member into the second position of any fracturing tool above the respective isolated zone.

8. The fracturing string and actuating member according to claim 1 adapted to sequentially fracture a plurality of the isolated zones, wherein:

the plurality of fracturing tools are connected in series with one another spanning the plurality of isolated zones such that each of the plurality of fracturing tools is associated with a respective stage of a respective isolated zone;

the actuating member is one of a plurality of actuating members and each of the plurality of actuating members is associated with one of the respective isolated zones;

the lowermost tool within each of the isolated zones has the seat sized to prevent displacement of the actuating member through the fracturing string beyond the bottom end of the respective isolated zone;

the burst plug of the at least one fluid port in each of the plurality of fracturing tools associated with the respective isolated zone is operable from the closed position to the open condition in response to the prescribed threshold hydraulic pressure level of the treatment fluid; and the actuating member associated with each of the plurality of isolated zones comprises a generally cylindrical shuttle member and a respective ball associated therewith, the shuttle member having a central passage extending longitudinally therethrough and a ball seat disposed in the central passage of the shuttle member so as to be arranged to form a seal against the flow of treatment fluid when the respective ball is seated on the ball seat, wherein the ball associated with each of the plurality of isolated zones is arranged to pass through the shuttle member of each fracturing tool associated with one of the isolated zones above the respective isolated zone without actuating the shuttle member to displace the sleeve members of any fracturing tool above the respective isolated zone into the second position.

9. The fracturing string and actuating member according to claim 1, wherein the burst plug in the at least one fluid port is adapted to open by bursting, rupturing or shearing in response to the prescribed threshold hydraulic pressure level of the treatment fluid.

10. The fracturing string and actuating member according to claim 1, wherein the burst plug comprises a material with consistent mechanical properties arranged to burst, rupture or shear in response to the prescribed threshold hydraulic pressure level of the treatment fluid.

11. The fracturing string and actuating member according to claim 10, wherein the burst plug comprises a metal.

12. The fracturing string and actuating member according to claim 11, wherein the at least one fluid port is a plurality of fluid ports circumferentially spaced about the tubular housing and oriented substantially perpendicular to a longitudinal axis of the tubular housing.

13. A method of hydraulically fracturing multiple stages within a lower isolated zone in a wellbore with a treatment fluid which can achieve a prescribed threshold hydraulic pressure level, the method comprising the steps of:

i) providing a plurality of the fracturing tools as defined in claim 1, each of the plurality of fracturing tools being connected in series with one another in a fracturing string spanning the lower isolated zone such that each of the plurality of fracturing tools is associated with a respective stage of the lower isolated zone;

ii) providing an actuating member to be associated with the plurality of fracturing tools associated with the lower isolated zone;

iii) providing a lowermost tool within the lower isolated zone having a seat sized to prevent displacement of the actuating member through the fracturing string beyond a bottom end of the isolated zone;

iv) directing the actuating member associated with the lower isolated zone downwardly through the fracturing string to sequentially displace the sleeve member of each of the plurality of fracturing tools associated with the lower isolated zone into the second position at an actuation hydraulic pressure level of treatment fluid which is less than the prescribed threshold hydraulic pressure level of treatment fluid;

v) locating the actuating member within the lowermost tool associated with the lower isolated zone so as to form a seal against a flow of the treatment fluid; and vi) pumping the treatment fluid to achieve the prescribed threshold hydraulic pressure level to open the burst plug in the at least one fluid port of only the plurality of fracturing tools associated with the lower isolated zone and to hydraulically fracture the wellbore within the lower isolated zone.

14. The method according to claim 13, further comprising hydraulically fracturing multiple stages within an upper isolated zone above the lower isolated zone by the steps of:

providing a plurality of the fracturing tools as defined in claim 1, each of the plurality of fracturing tools being connected in series with one another in a fracturing string spanning the upper isolated zone such that each of the plurality of fracturing tools is associated with a respective stage of the upper isolated zone;

providing one of the actuating members to be associated with the plurality of fracturing tools associated with the upper isolated zone;

providing a lowermost tool within the upper isolated zone having a seat sized to prevent displacement of the actuating member through the fracturing string beyond a bottom end of the isolated zone;

repeating steps iv) to vi), but adapted to hydraulically fracture the wellbore within the upper isolated zone.

15. The method according to claim 14, wherein the isolated zone of the wellbore includes a cement liner.

16. The method according to claim 14, wherein the isolated zone of the wellbore includes a plurality of packers.

* * * * *